United States Patent [19]

Sardar

[11] Patent Number: 4,988,314

[45] Date of Patent: Jan. 29, 1991

[54] CONNECTOR

[76] Inventor: Zuhdi Sardar, 688 Sante Fe, No. 110, Los Angeles, Calif. 90021

[21] Appl. No.: 427,022

[22] Filed: Oct. 26, 1989

[51] Int. Cl.[5] ..... H01R 13/00

[52] U.S. Cl. ..... 439/628

[58] Field of Search ..... 439/628, 675, 668, 669

[56] References Cited

U.S. PATENT DOCUMENTS

| | | | |
|---|---|---|---|
| 1,484,992 | 2/1924 | Kijima | 439/675 |
| 2,225,461 | 12/1940 | Reynolds | 439/675 |
| 4,248,494 | 2/1981 | McDonald | 439/668 |
| 4,593,464 | 6/1986 | Williams et al. | 439/675 |
| 4,857,014 | 8/1989 | Alf et al. | 439/628 |

*Primary Examiner*—Joseph H. McGlynn

*Attorney, Agent, or Firm*—Julius Rubinstein

[57] ABSTRACT

An electrical connector for audio devices using earphones, has the shape of a snap jack in contrast to the conventional plugs and jacks which are long and thin. The snapjack shape of the connector provides a large area of electrical contact between the plug and the jack, so that if the audio device is portable and subjected to intense vibration, the electrical connection between the plug and jack will be strong enough to withstand this vibration without introducing noise into the circuit.

6 Claims, 1 Drawing Sheet

CONNECTOR

This invention relates to an electrical connector and more particularly to detachable electrical connectors for use in high vibration environments such as in aircraft or for attaching earphones to portable sound systems such as a radio, disc, or cassette player.

BACKGROUND AND BRIEF SUMMARY

Earphones with attached plugs for connection to jacks in audio sound systems have long been used. The plugs attached to the earphones, were generally cylindrical in shape with a length much larger than the diameter of the plug and this plug was designed to be inserted in a jack having similar dimensions.

As long as this type of connector was used in the home or in situations where the audio device was stationary, they were satisfactory. In recent years, however, audio devices capable of producing high quality sound have become small and compact, so it is now common for people to put earphones on their ears and listen to the audio device as they walk, run, or ride bicycles or motorcycles, etc. This has created a different and rougher environment which the previous plugs and jacks were not designed to withstand. As a consequence the shaking and vibration caused when the audio device was played while the owner was walking, running, or riding a bicycle gradually weakened the electrical connection between the plug and the jack causing noise to be introduced into the earphones. This noise was all the more noticeable because of the high quality sound the device was capable of producing, so that the enjoyment of the sound being heard was diminished.

To overcome this problem ear phones having a connector with a differently designed plug and jack capable of withstanding rough usage such as caused by aircraft vibration or when the owner was running or riding a bicycle without introducing noise into the system is required, and to provide such a connector comprises an important object of this invention.

These and other objects of this invention will become more apparent when better understood in the light of the accompanying specification and drawings wherein:

FIG. 1 is a perspective view of a set of earphones and a plug connected to a jack on an audio device where the plug and jack are constructed according to the principles of this invention.

FIG. 2 discloses a sectional elevational view of the novel plug and jack connected together.

Figure 1:
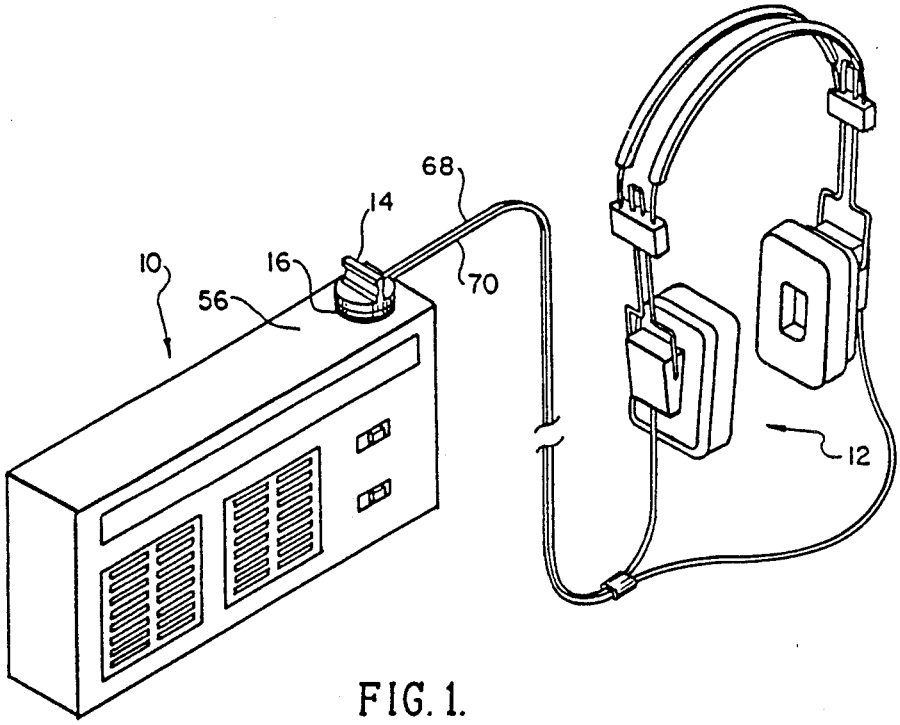
Figure 2:
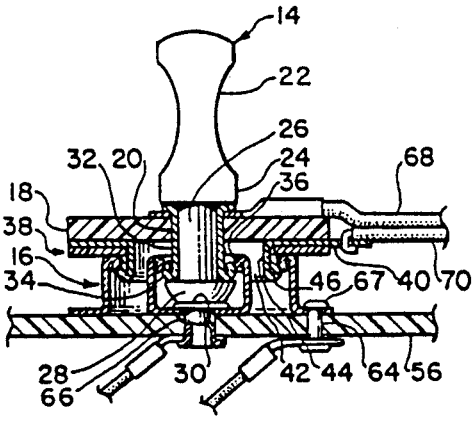
Figure 3:
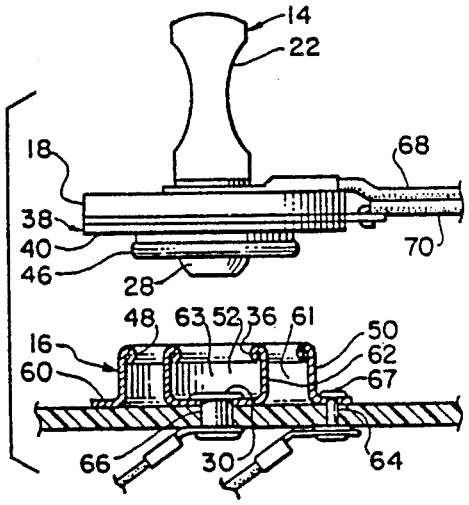
FIG. 3 is an elevational sectional view of the novel jack shown in FIG. 2 with an elevational view of the plug removed from and above the jack.
Figure 4:
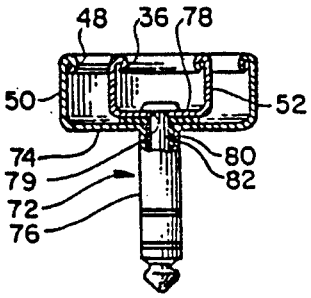
FIG. 4 is an elevational view of the adaptor.

Referring now to FIG. 1 of the drawing, an audio device player, and indicated by the reference numeral 10 is shown connected to a pair of earphones 12 through stereo wires 68 and 70 by a novel plug 14 and jack 16, shown more clearly in FIGS. 2 and 3.

The novel plug and jack resemble a common snap jack, but the plug 14 support a support 18 formed from a non-conductive material. The support 18 has a centrally disposed hole 20. A handle 22 for the plug 1 formed from a non-conductive material is attached to the support 18 and is mounted over the hole 20. An extension pin 26 is attached to the base 24 of the handle and this extension pin is formed from a conductive material. The extension pin 26 terminates in an electrically conductive head 28 which is shaped something like an inverted mushroom. The head 28 is positioned to engage an electrical contact 30 on the upper end of a rivet-like member 66 see FIG. 2. The rivet-like member 66 is mounted as shown in FIGS. 2 and 3 on the jack 16 and the head 30 of the member 66 is the electrical contact which engages the head 28 of the extension pin 26 when the plug and jack are connected together. A sleeve 31, formed from a non-conductive material surrounds the extension pin 26, see FIG. 2 and is attached to it. A first cylindrical sleeve connector 32 formed from electrically conductive material surrounds and non-conductive sleeve 31, for reasons to become apparent below. The sleeve 32 terminates in an upwardly curved terminal or formation 34, which is shaped to interlock with a downwardly curved terminal or formation 36 formed in the jack 16, see FIGS. 2 and 3 and forms the first plug connector.

The plug 14 is provided with a concentric second generally cylindrical sleeve 38. This connector has an electrically conductive circular portion 40 with a concentric opening 42 that is concentric with the circular portion 40 and the extension pin 26 which extends through the opening 42. The circular portion 40 curves downward at the perimeter of the opening 42 to form a cylindrical sleeve connector 44 which terminates in an upwardly curved formation or terminal 46 shaped to interlock with a downwardly curved formation or terminal 48 on the jack 16, see FIGS. 2 and 3.

The jack 16 comprises a first circular outer mounting ring 60 having an inner concentric centrally disposed opening 61, see FIG. 3. The inner periphery of said opening 61 is bent upwards defining a first cylindrical sleeve or wall 63 formed from resilient electrically conductive material. A second radially inwardly spaced circular mounting ring 62 is positioned inside ring 60 and is concentric with the circular opening 61 in ring 60. Ring 62 has a centrally disposed inner opening 65, see FIG. 3. The outer periphery of opening 65 is bent upwardly defining a second upwardly extending electrically conductive tubular flange or wall 67. The upper portion of walls 63 and 67 terminate in downwardly curved connector terminals 36 and 48, which interlock with the terminals or connectors 36 and 46 on the plug 14, see FIGS. 2 and 3. Electrically conductive rivets 57, 66 and 59 extend through the upper wall 54 of the housing 56. These heads as shown in FIGS. 2 and 3 are connected by wires to the left and right portions of the stereo electrical circuit (not shown) inside the audio housing 54.

The earphones 12 in accordance with current technology, are designed for stereo listening, and as shown in FIGS. 1 and 2 comprise two coaxial cables 68 and 70. As shown in FIG. 2, one wire 69 of cable 68 is electrically connected to the cylindrical sleeve 32 and is connected thereby to the rivet 59 which leads to the stereo circuit inside the audio device. One wire 71 of cable 70 is electrically connected to the cylindrical sleeve 63 and is connected thereby to rivet 57 which leads to the stereo circuit inside the audio device 10, see FIG. 3. The remaining coaxial wires 73 and 75 in the cables 68 and 70 are electrically connected to the conductive sleeve 32 which is electrically connected to the rivet 66 which is connected to the ground of the circuit to complete the circuit to the earphones in a manner well known in the art. The resilience of the upwardly extending electrically conductive concentric cylindrical sleeves or walls 66 and 67 and the shape of their downwardly curved terminals on the jack 16 cause these terminals to make an electrically secure interlocking connection with the upwardly curved terminals 34 and 46 on the plug 14.

FIGS. 2 and 3 of the drawings indicate that the diameter of the plugs 14 and the jack 16 is much larger than their height. This means that the circumferential length of the electrical contacts between the downward terminals on the jack 16 and the interlocked upwardly curved terminals on the plug, along with the small height of the plug 14 and the jack 16 see FIGS. 1 and 2, make it unlikely that any kind of vibration likely to be encountered could weaken the electrical contact between the plug and jack and thereby cause noise to be introduced into the earphones.

Having described the invention what I claim as new is:

1. An electrical connector for use with wires connected to earphones for connection to a sound system, said connector comprising a plug and jack, said plug and jack each having concentric outer and inner radially spaced generally cylindrical sleeves formed from electrically conductive material for connection to the wires, formations on the peripheries of said concentric generally cylindrical surfaces, said formations on the peripheries of said generally cylindrical surfaces shaped and positioned so the said formations on the plug and jack are releasably electrically interlocked together when the plug and jack are pressed together, said plug and jack shaped so the circumferential length of the interlocked cylindrical surfaces on the plug and jack is much greater than the thickness of the interlocked plug and jack so when they are pressed together they resemble a snapjack, whereby the electrically connected peripheries of the interlocked plug and jack have a large area of electrical contact enabling them to withstand rough handling without introducing noise into the earphones.

2. The electrical connector described in claim 1 including a handle secured to the plug, A pin formed form electrically conductive material secured to said handle, said pin concentric with said outer and inner generally cylindrical surfaces on said plug and adapted to be connected to some of the wires attached to said earphones, said pin connected to a grounded contact on said jack when the plug and jack are pressed together.

3. The electrical connector described in claim 2 including a housing for said sound system, said jack mounted on said housing and adapted to be electrically connected to the circuit inside said housing.

4. An electrical connector for use with a pair of earphones in an audio device adapted to be mounted in a housing, comprising a plug and a jack, said plug comprising concentric outer and radially inwardly spaced downwardly extending generally cylindrical sleeves and a centrally disposed electrically conductive pin, a pair of coaxial audio cables, one wire in each pair electrically connected from one earphone to one of the generally cylindrical surfaces of the plug, the remaining wire in each pair connected to said grounded conductive pin, said jack comprising concentric outer and radially inwardly spaced upwardly extending generally cylindrical sleeves formed from a resilient electrically conductive material and adapted to be mounted on the housing for the sound system for connection to the audio system inside the housing, the diameters of the outer and inner downwardly extending generally cylindrical connectors on the plug generally equal to the diameters of the outer and inner upwardly extending generally cylindrical connectors on the jack, formations on the peripheries of the cylindrical connectors on the plug and the jack, said formations shaped so that when the plug and jack are releasably pressed together, the outer and inner cylindrical connectors on the plug become interlocked with the outer and inner cylindrical connectors on the jack, the height of the interlocked generally cylindrical plug and jack small in comparison to the circumference of the interlocked sleeves to provide a large area of electrical contact able to withstand rough handling without the introduction of noise, said pin connected to a grounded extension on said jack for connection to the circuit inside the housing when the plug and jack are pressed together.

5. A plug for an electrical connector for use with a pair of earphones in an audio device mounted in a housing, coaxial cables adapted to be connected to said earphones and said plug on the audio device, said plug including a support formed from an insulating material, said support formed with a centrally disposed hole, a first electrically conductive generally cylindrical sleeve attached to the support and extending downward from the hole transverse to said surface, a second electrically conductive downwardly extending cylindrical surface attached to said support in radially outwardly spaced relationship to said first generally cylindrical surface and generally concentric therewith, and formations on the distal ends of said first and second cylindrical surfaces shaped to be electrically interlocked with correspondingly positioned formations on a jack, the electrically connected circumferential length of said cylindrical sleeves much greater than the thickness of the plug so when the plug and jack are pressed together they resemble a snapjack and provide a large circumferential area of electrical contact between the electrical contacts between the plug and jack to enable the plug and jack to withstand rough handling without introducing noise in the earphones.

6. A plug for an electrical connector for use with a pair of earphones in an audio device mounted in a housing, comprising a support formed from an insulating material, said support formed with a centrally disposed hole, a first electrically conductive generally cylindrical surface attached to and extending downward from the hole transverse to said support, a second electrically conductive downwardly extending cylindrical surface attached to said support in radially outwardly spaced relationship to said first generally cylindrical surface and generally concentric therewith, a handle secured to said support, a conductive pin connected to said handle and extending downward from said support concentric with said first and second generally cylindrical surfaces, and formation on the distal ends of said first and second cylindrical surfaces shaped to be releasably electrically interlocked with correspondingly positioned formation on a jack, the electrically connected circumferential length of said cylindrical surfaces much greater than the thickness of the plug so when the plug and jack are pressed together they resemble a snapjack they provide a large circumferential area of electrical contact plug to enable the plug and jack to withstand rough handling without introducing noise in the earphones, and a pair of coaxial audio wires, one wire in each pair electrically connected from one earphone to one of the generally cylindrical surfaces on the plug, the remaining wire in each pair connected to said conductive pin, said pin adapted to be in electrical engagement with one of the grounded terminals in the circuit of the audio device.

* * * * *